US011560001B2

(12) United States Patent
Shirasaki

(10) Patent No.: US 11,560,001 B2
(45) Date of Patent: Jan. 24, 2023

(54) IMAGE FORMING SYSTEM

(71) Applicant: KYOCERA Document Solutions Inc., Osaka (JP)

(72) Inventor: Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 106 days.

(21) Appl. No.: 17/365,720

(22) Filed: Jul. 1, 2021

(65) Prior Publication Data

US 2022/0001682 A1 Jan. 6, 2022

(30) Foreign Application Priority Data

Jul. 6, 2020 (JP) ..... JP2020-116616

(51) Int. Cl.

| | |
|---|---|
| ***B41J 13/00*** | (2006.01) |
| ***B41J 29/38*** | (2006.01) |
| ***B41J 13/16*** | (2006.01) |
| ***B41J 11/00*** | (2006.01) |
| ***B65H 7/04*** | (2006.01) |

(52) U.S. Cl.

CPC ..... *B41J 13/16* (2013.01); *B41J 11/0075* (2013.01); *B41J 13/0009* (2013.01); *B41J 29/38* (2013.01); *B65H 7/04* (2013.01); *B65H 2301/4381* (2013.01)

(58) Field of Classification Search

CPC .... B41J 13/16; B41J 11/0075; B41J 13/0009; B41J 29/38; B65H 7/04; B65H 2301/4381

See application file for complete search history.

(56) References Cited

U.S. PATENT DOCUMENTS

| | | | | |
|---|---|---|---|---|
| 2001/0018626 | A1 | 8/2001 | Moriyama et al. | 700/223 |
| 2003/0063940 | A1* | 4/2003 | Furuya | B41J 13/0009 400/624 |
| 2006/0051686 | A1* | 3/2006 | Ide | G03G 15/2064 430/123.54 |
| 2013/0222505 | A1 | 8/2013 | Akatsuka et al. | 347/110 |
| 2020/0307274 | A1* | 10/2020 | Yumoto | G03G 15/6555 |

FOREIGN PATENT DOCUMENTS

| | | | | |
|---|---|---|---|---|
| JP | 2001-163507 A | | 6/2001 | |
| JP | 2003021984 A | * | 1/2003 | G03G 15/36 |
| JP | 2013-180842 A | | 9/2013 | |
| JP | 2019-108187 A | | 7/2019 | |

* cited by examiner

*Primary Examiner* — Yaovi M Ameh

(74) *Attorney, Agent, or Firm* — Stein IP, LLC

(57) ABSTRACT

An image forming system includes an image forming apparatus, a first conveyance path, a sheet feeding unit, a sheet post-processing unit, and a controller. The image forming apparatus has a first feed portion, and an image forming portion. The sheet feeding apparatus has a sheet stacking portion, a second feed portion, a relay conveyance portion, and a remaining amount detecting portion. When, during continuous printing, the existing number of recording sheets present in a conveyance passage from a confluence portion to the first feed portion is more than the constituting number of recording sheets contained in one bundle of sheets and in addition the sensing result of the remaining amount sensor is equal to or less than a predetermined amount, the controller controls first feed portion such that the existing number of the recording sheets is less than the constituting number of recording sheets.

7 Claims, 6 Drawing Sheets

IMAGE FORMING SYSTEM

INCORPORATION BY REFERENCE

This application is based on and claims the benefit of Japanese Patent Application No. 2020-116616 filed on Jul. 6, 2020, the contents of which are hereby incorporated by reference.

BACKGROUND

The present disclosure relates to a sheet feeding unit for inserting a cover sheet, a slip sheet, or the like among a plurality of sheets having images formed on them by an image forming apparatus such as an image forming apparatus, facsimile machine, or printer. The present disclosure also relates to an image forming system that employs such a sheet feeding unit.

A known image forming system includes an image forming apparatus, a sheet feeding unit connected downstream of the image forming apparatus, and a sheet post-processing unit connected downstream of the sheet feeding apparatus. In such an image forming system, among a plurality of recording sheets having images formed on them by the image forming apparatus, insertion sheets to become cover sheets or slip sheets are inserted from the sheet feeding apparatus to produce a bundle of sheets that contains recording sheets and insertion sheets, and the bundle of sheets is subjected to predetermined post-processing by the sheet post-processing apparatus to produce a booklet.

SUMMARY

According to one aspect of the present disclosure, an image forming system includes an image forming apparatus, a first conveyance path, a sheet feeding unit, a sheet post-processing unit, and a controller. The image forming apparatus includes: a sheet storage portion that stores recording sheets; a first feed portion that feeds one by one the recording sheets from the sheet storage portion downstream in the sheet feeding direction; and an image forming portion that forms images on the recording sheets fed by the first feed portion. The first conveyance path conveys the recording sheets fed from the first feed portion to a discharge port; The sheet feeding unit include: a sheet stacking portion on which insertion sheets are stacked; a second feed portion that feeds one by one the insertion sheets stacked on the sheet stacking portion; and a relay conveyance portion that receives the recording sheets fed by the first feed portion and the insertion sheets fed by the second feed portion to convey them downstream in the sheet conveyance direction. The sheet feeding unit being coupled to the image forming apparatus on a downstream side. The sheet post-processing unit coupled to the sheet feeding unit on a downstream side. The sheet post-processing unit forming a bundle of sheets containing the insertion sheets and the recording sheets and performing predetermined post-processing on the bundle of sheets. The controller controls the image forming apparatus, the sheet feeding unit, and the sheet post-processing unit. The sheet feeding unit has a remaining amount detecting portion that detects a remaining amount of the insertion sheets on the sheet stacking portion. The relay conveyance portion has a merge portion at which an insertion conveyance path for conveying the insertion sheets merges with a relay conveyance path for conveying the recording sheets meet. When, during continuous printing, an existing number of the recording sheets present in a conveyance path including the first conveyance path and the relay conveyance path is more than a constituting number of the recording sheets contained in the bundle of sheets and the remaining amount of the insertion sheets detected by the remaining amount detecting portion is equal to or less than a predetermined amount level, the controller controls the feeding of recording sheets from the first feed portion such that the existing number of the recording sheets in the conveyance path is less than the constituting number of recording sheets.

DETAILED DESCRIPTION

Figure 1:
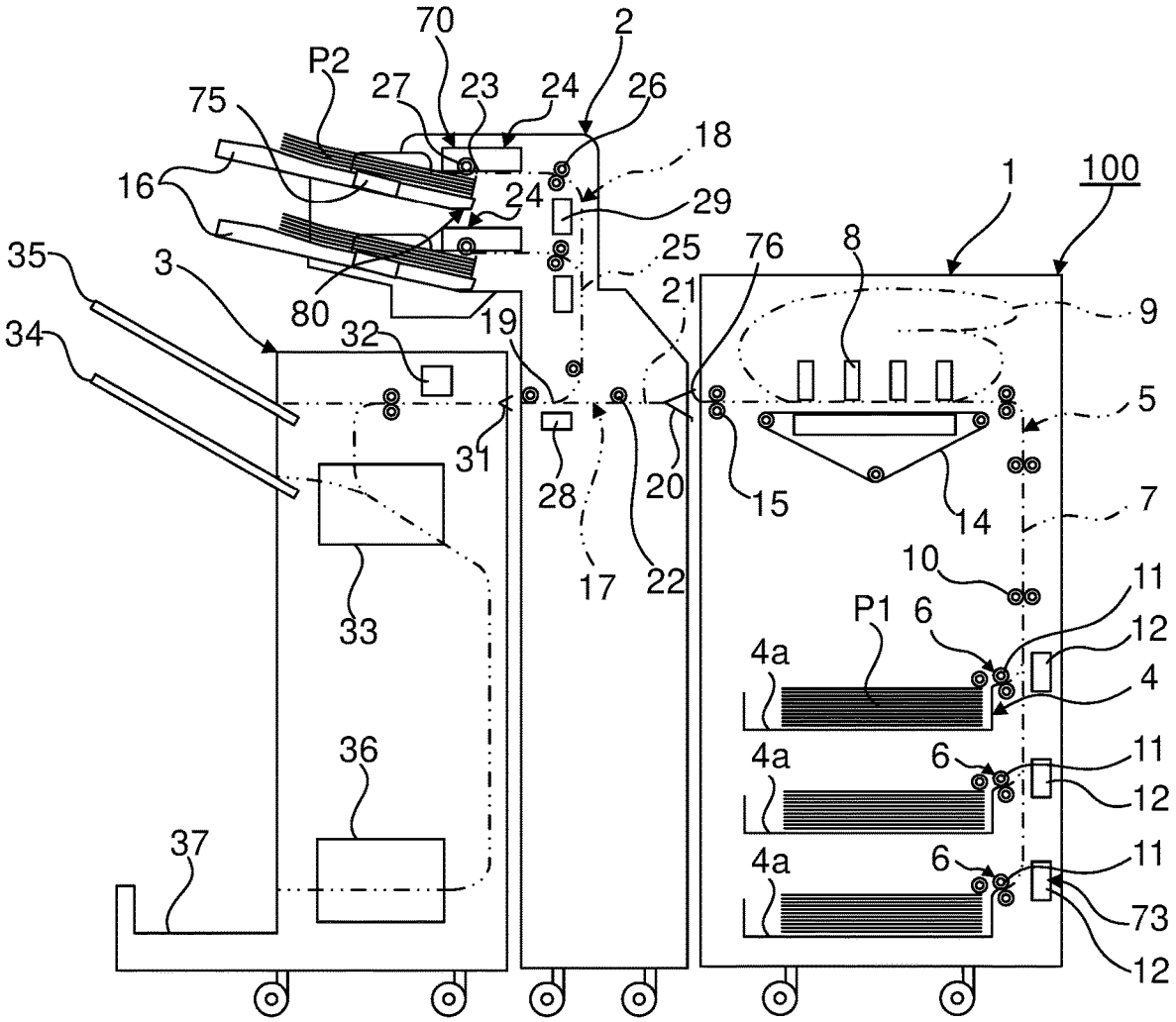
FIG. 1 is an outline diagram showing an internal construction of an image forming apparatus 1, a sheet feeding unit 2, and a sheet post-processing unit 3 that constitute an image forming system 100.

An embodiment of the present disclosure will be described below with reference to the accompanying drawings.

First, with reference to FIG. 1, a description will be given of an image forming system 100 comprising an image forming apparatus 1, a sheet feeding unit 2, and a sheet post-processing unit 3. This embodiment deals with an image forming system 100 that employs as the image forming apparatus a printer of an inkjet recording type, though any other image forming apparatus (e.g., a laser printer or image forming apparatus, or a facsimile machine) may be employed instead. The direction in which recording sheets P1 output from the image forming apparatus 1 and insertion sheets P2 inserted from the sheet feeding apparatus 2 are conveyed toward the sheet post-processing apparatus 3 will be referred to as the sheet conveyance direction. With respect to the sheet conveyance direction, downstream refers to the side where the sheet post-processing apparatus 3 is located, whereas upstream refers to the side where a sheet storage portion 4 in the image forming apparatus 1 and a sheet stacking portion 10 in the sheet feeding apparatus 2, where insertion sheets P2 are stacked, are located.

FIG. 1 is an outline diagram showing an internal construction of the image forming apparatus 1, the sheet feeding apparatus 2, and the sheet post-processing apparatus 3 that constitute the image forming system 100. Downstream of the image forming apparatus 1, the sheet feeding apparatus 2 is connected to it. Downstream of the sheet feeding apparatus 2, the sheet post-processing apparatus 3 is connected to it.

The image forming apparatus 1 includes a first feed portion 4 and a first conveyance portion 5. The first feed portion 4 is provided in a lower part of the image forming apparatus 1, and stores a plurality of recording sheets P1. The first conveyance portion 5 feeds from the first feed portion 4 the recording sheets P1 one by one downstream in the sheet conveyance direction.

The first feed portion 4 includes a plurality of (here, three) sheet feed cassettes 4*a* (sheet storing portions). These sheet feed cassettes 4*a* are disposed over one another in the up-down direction. By placing recording sheets P1 of different sizes on the different sheet feed cassettes 4*a*, it is possible to produce booklets that contains recording sheets of varying sizes.

The first conveyance portion 5 (the first conveyance path in the claim) includes a sheet conveyance passage 7 and a plurality of sheet feed portions 6. The sheet conveyance passage 7 is connected to the sheet feed cassettes 4*a*, and extends from a side of the first feed portion 4 downstream in the sheet conveyance direction. In the sheet conveyance passage 7, a plurality of pairs of conveying rollers 10 are provided, which convey the recording sheets P1 inside downstream in the sheet conveyance direction.

The sheet feed portions 6 are provided between the sheet conveyance passage 7 and the sheet feed cassettes 4*a* respectively. In the sheet feed portion 6, a pair of feed rollers 11 is provided, which feeds the recording sheets P1 stored in the first feed portion 4 to the sheet conveyance passage 7.

In each sheet feed portion 6, a feed sensor 12 is provided. The feed sensor 12 senses a recording sheet P1 being fed from the first feed portion 4. A sense signal from the feed sensor 12 is transmitted to a controller 59 in the image forming apparatus 1 (see FIG. 4). The feed sensor 12, along with a feed counter 13 (sheet number counting portion), which will be described later, constitutes a counting device 73 that counts the number of recording sheets P1 that are fed.

Over the first feed portion 4, adjacent to the sheet conveyance passage 7 in the height direction, an image recording portion 8 (image forming portion) is disposed. A reversal conveyance passage 9 is provided that branches off the sheet conveyance passage 7 to extend over the image recording portion 8.

Under the image recording portion 8, a conveying belt 14 is provided, which is endless and which is stretched around a plurality of rollers including a driving roller. In the conveying belt 14, a large number of ventilation holes (not illustrated) for air suction are provided. When a recording sheet P1 fed from the first feed portion 4 reaches the conveying belt 14, it then passes, in a state sucked and held on the conveying belt 14 by a sheet suction portion provided on the inner side of the conveying belt 14, under the image recording portion 8.

The image recording portion 8 includes a plurality of inkjet heads, which eject ink toward the recording sheet P1 conveyed in a state sucked and held on the conveying belt 14. The inkjet heads are supplied with ink of four colors (cyan, magenta, yellow, and black) stored in ink tanks (not illustrated) respectively.

When images are recorded on both sides of a recording sheet P1, the recording sheet P1 having undergone recording on one side is conveyed to the reversal conveyance passage 9 so that its conveyance direction is switched (it is switched back). The recording sheet P1 is turned around reverse side up, and is then, with the side having no image recorded on it yet facing up, conveyed once again to the image recording portion 8, where an image is recorded. Recording sheets P1 having predetermined image recorded on them by the image recording portion 8 are discharged one by one via a pair of discharge rollers 15, which is provided near a discharge port 76 in a downstream end part of the sheet conveyance passage 7.

The sheet feeding apparatus 2 introduces one by one the recording sheets P1 discharged from the image forming apparatus 1, and inserts, with predetermined timing, insertion sheets P2—such as front covers and back covers (cover sheets) used in binding and slip sheets (insertion sheets) for indexing—among the introduced recording sheets P1. The sheet feeding apparatus 2 then conveys those recording sheets P1 and insertion sheets P2 to the sheet post-processing apparatus 3.

The sheet feeding apparatus 2 includes an insertion conveyance passage 25, a relay conveyance portion 17, an insertion conveyance passage 18, and a second feed portion 80. The second feed portion 80 is provided in an upper part of the sheet feeding apparatus 2. The relay conveyance portion 17 is provided under the second feed portion 80. The relay conveyance portion 17 receives the recording sheets P1 conveyed from the image forming apparatus 1 and conveys them downstream. The insertion conveyance passage 18 is provided between the second feed portion 80 and the relay conveyance portion 17. The insertion conveyance passage 18 meets the relay conveyance portion 17 in a confluence portion 19.

The relay conveyance portion 17 includes an inlet port 20, which is open upstream in the sheet conveyance direction and through which the recording sheets P1 output from the image forming apparatus 1 are received; a relay conveyance passage 21, which extends from the inlet port 20 downstream in the sheet conveyance direction; and a relay conveyance roller 22, which is provided midway along the relay conveyance passage 21 and which conveys the recording sheets P1 inside the relay conveyance passage 21 downward.

The second feed portion 80 includes one or more (here, two) sheet feed units 24 that feed insertion sheets P2.

Each sheet feed unit 24 includes a sheet stack portion 16, a remaining amount detecting portion 70, and an upstream end opening 23. On the sheet stack portion 16, insertion sheet P2 are stacked. The remaining amount detecting portion 70 is provided in the sheet stack portion 16, and senses the remaining amount of insertion sheets P2. The upstream end opening 23 is adjacent to the sheet stack portion 16 in the sheet conveyance direction.

The insertion conveyance passage 25 extends in the sheet conveyance direction from the upstream end opening 23 toward the confluence portion 19 with the relay conveyance passage 21. The insertion conveyance passage 25 forms a passage through which the sheet stack portion 16 and the relay conveyance passage 21 communicate with each other.

The sheet feed unit 24 is provided over the upstream end opening 23. The sheet feed unit 24 includes a sheet feed roller 27, which is provided to be adjacent to the upstream end opening 23 of the insertion conveyance passage 25 in the sheet conveyance direction. The sheet feed roller 27 makes contact with the top surface of the insertion sheets P2 on the sheet stack portion 16. Midway along the insertion conveyance passage 25 in the sheet conveyance direction, a pair of conveying rollers 26 is provided.

With the sheet feed roller 27 in contact with the top surface of the insertion sheets P2, the sheet feed unit 24 rotates the sheet feed roller 27 to feed an insertion sheet P2 to the insertion conveyance passage 25. The insertion sheet P2 fed to the insertion conveyance passage 25 is conveyed by the pair of conveying rollers 26 to the confluence portion 19, where the insertion sheet P2 is inserted into the relay conveyance passage 21 to be conveyed to the sheet post-processing apparatus 3. In this way the second feed portion 80 inserts, with predetermined timing, insertion sheets P2 from the sheet stack portion 16 among a plurality of recording sheets P1 that pass through the confluence portion 19.

In the confluence portion 19 of the relay conveyance passage 21, a confluence sensor 28 is provided, which can sense recording sheets P1 that reach the confluence portion 19. A sense signal from the confluence sensor 28 is transmitted to the controller 59 (see FIG. 4).

In the sheet stack portion 16, a sheet sensor 75 is provided. The sheet sensor 75 can sense whether or not there are any insertion sheets P2 on the sheet stack portion 16. When the insertion sheets P2 on the sheet stack portion 16 run out, the sheet sensor 75 transmits a sense signal to the controller 59 in the image forming apparatus 1.

In the insertion conveyance passage 25, midway from the upstream end opening 23 to the confluence portion 19, an insertion sensor 29 is provided, which senses the passage of insertion sheets P2. A sense signal from the insertion sensor 29 is transmitted to the controller 59 in the image forming apparatus 1 (see FIG. 4).

The sheet post-processing apparatus 3 performs predetermined post-processing, such as punch hole formation and binding, on a bundle of sheets that contains a plurality of recording sheets P1 output from the image forming apparatus 1 and insertion sheets P2 inserted among the recording sheets P1.

The sheet post-processing apparatus 3 includes a sheet inlet port 31 through which it receives the recording sheets P1 and insertion sheets P2 conveyed from the sheet feeding apparatus 2. The sheet post-processing apparatus 3 includes, provided inside it, a punch hole forming device 32, an end binding unit 33, and a middle-binding middle-folding unit 36. The punch hole forming device 32 forms punch holes in the recording sheets P1 and insertion sheets P2 introduced through the sheet inlet port 31. The end binding unit 33 stacks a plurality of recording sheets P1 and insertion sheets P2 introduced to form a bundle of sheets and then aligns and binds with staples an end part of the bundle. The middle-binding middle-folding unit 36 applies staples at the middle of a bundle of sheet and then folds it about the stapled part into the form of a booklet. On a side surface of the sheet post-processing apparatus 3, there are provided a main tray 34, which can be lifted and lowered to a position suitable for discharge of a bundle of sheets, and a subsidiary tray 35, which is fixed to an upper part of the sheet post-processing apparatus 3.

The punch hole forming device 32 is disposed in an upper part of the sheet post-processing apparatus 3. The recording sheets P1 and insertion sheets P2 that have passed through the relay conveyance passage 21 in the sheet feeding apparatus 2 are fed to the sheet post-processing apparatus 3 through the sheet inlet port 31, which is provided in a top left part of it, and pass through the punch hole forming device 32. When no stapling is performed on the recording sheets P1 and insertion sheets P2, they are discharged as they are onto the subsidiary tray 35; when stapling is performed, they are conveyed to the end binding unit 33 or the middle-binding middle-folding unit 36, which are disposed under the punch hole forming device 32.

The end binding unit 33 includes a stapler, a processing tray, etc. (of which none is illustrated). The recording sheets P1 and insertion sheets P2 introduced are stacked on the processing tray, and form a bundle of sheets. This bundle of sheets is, in a state aligned at the leading end, bound in an end part by the stapler, which is provided in an end part of the processing tray, and is then discharged along the processing tray onto the main tray 34.

The middle-binding middle-folding unit 36 is disposed under the end binding unit 33. The middle-binding middle-folding unit 36 includes a middle-binding stapler, a middle-folding device, a sheet guide, etc. (of which none is illustrated). The middle-binding stapler staples a middle part of the bundle of sheets placed in the sheet guide. The bundle of sheets stapled by the middle-binding stapler is folded about the stapled part by the middle-folding device into the form of a booklet and is then discharged onto a booklet tray 37.

As described above, the sheet feeding apparatus 2 includes a plurality of sheet stack portions 16. By placing different insertion sheets P2 on the different sheet portions 16, it is possible to produce booklets that contain different types of insertion sheets P2 as front covers, back covers, and the like.

In this way a predetermined number of recording sheets P1 fed from the image forming apparatus 1 and a predetermined number of insertion sheets P2 fed from the sheet feeding apparatus 2 are conveyed to the sheet post-processing apparatus 3 to be formed into a bundle of sheets, on which predetermined post-processing is performed to produce a booklet.

Figure 2:
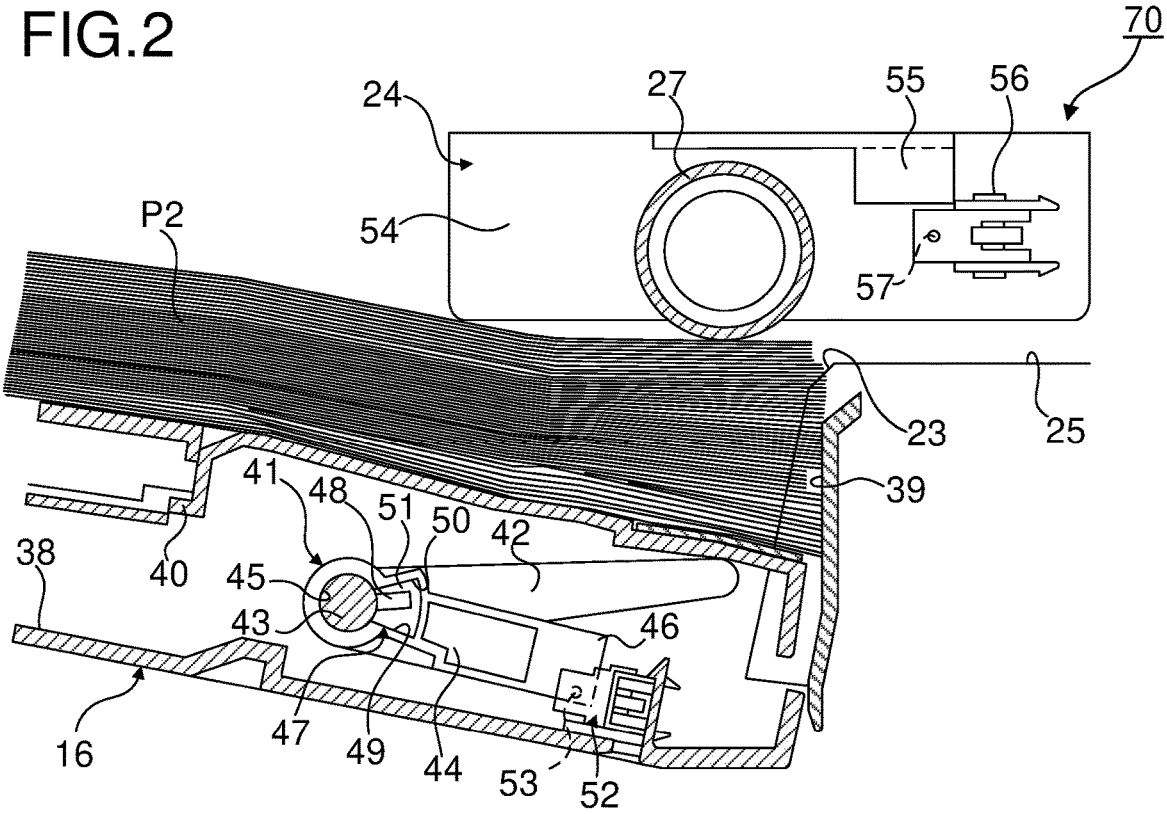
FIG. 2 is an enlarged part view showing a state where the remaining amount of insertion sheets P2 on a sheet stack portion 16 is equal to or more than a predetermined amount.
Figure 3:
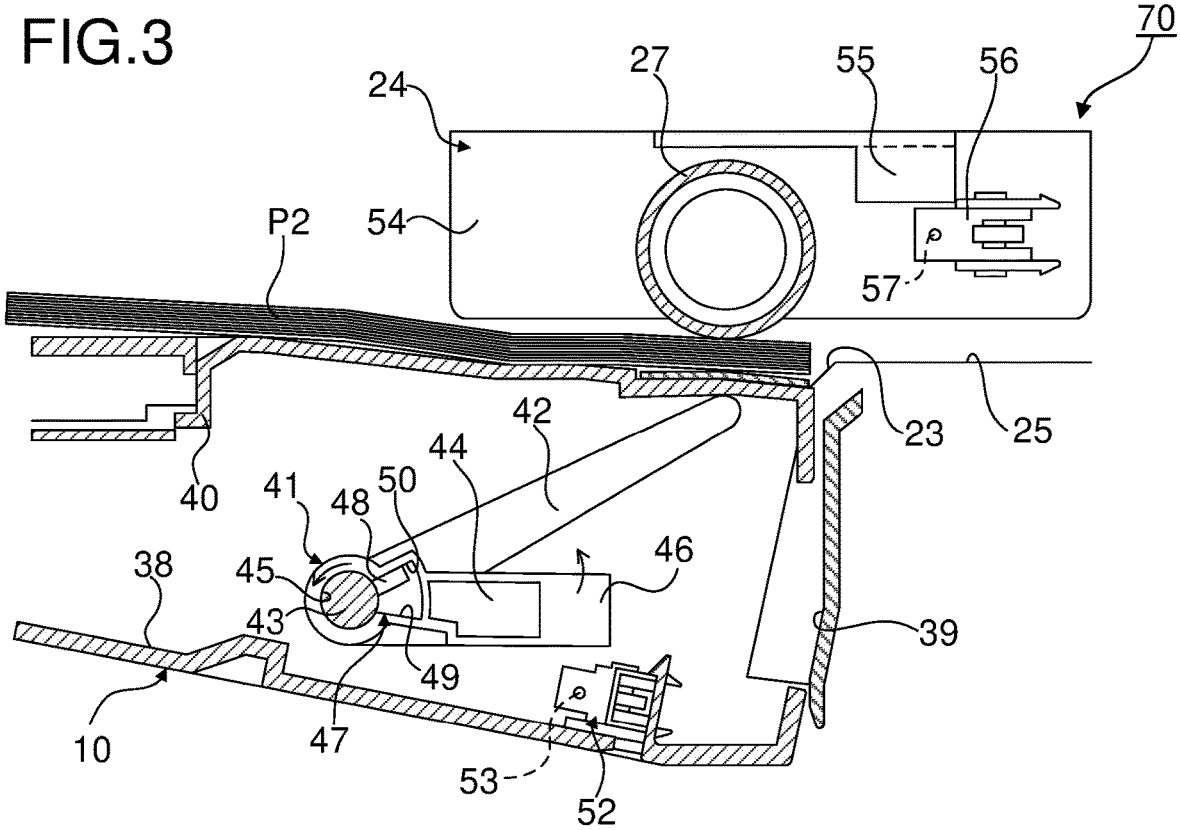
FIG. 3 is an enlarged part view showing a state where the remaining amount of insertion sheets P2 on the sheet stack portion 16 is equal to or less than the predetermined amount.

Next, with reference to FIGS. 2 and 3, how the remaining amount detecting portion 70 senses the remaining amount of insertion sheets P2 on the sheet stack portion 16 will be described in detail. FIGS. 2 and 3 are enlarged part views around the sheet feed unit 24, as seen from the sheet width direction. FIG. 2 shows a state where the remaining amount of insertion sheets P2 on the sheet stack portion 16 is equal to or more than a predetermined amount. FIG. 3 shows a state where the remaining amount of insertion sheets P2 on the sheet stack portion 16 is equal to or less than the predetermined amount.

As shown in FIGS. 2 and 3, the sheet stack portion 16 has a floor surface 38, which is inclined so as to rise from downstream (the right side in the illustration) to upstream (the left side in the illustration) in the sheet conveyance direction, and an upright wall portion 39, which is located in a downstream end part of the floor surface 38. In a top part of the upright wall portion 39, the upstream end opening 23 of the insertion conveyance passage 25 is provided.

On the floor surface 38 of the sheet stack portion 16, a lift plate 40 is disposed. The insertion sheets P2 in the sheet stack portion 16 are stacked on the lift plate 40. The lift plate 40 is adjacent to the upright wall portion 39 of the sheet stack portion 16 in the sheet conveyance direction. The lift plate 40 is, in an upstream end part (not illustrated) of it, supported pivotably so as to be, in a downstream end part of it, ascendable-descendable in the height direction (in the up-down direction in the illustration).

Between the floor surface 38 of the sheet stack portion 16 and the lift plate 40, a lift mechanism 41 is provided, which raises and lowers the downstream end part of the lift plate 40. The lift mechanism 41 includes an actuating segment 42, a driving source 71 (see FIG. 4) such as a motor for generating a driving force, and a driving shaft 43 rotatably connected to the driving source 71.

The driving shaft 43 is located below the lift plate 40, and extends in the sheet width direction (the direction perpendicular to the plane of illustration), which is orthogonal to the sheet conveyance direction. The actuating segment 42 is a plate member in the shape of a rectangle elongate in the sheet conveyance direction. An upstream end part of the actuating segment 42 is fixed to the driving shaft 43. As the driving shaft 43 rotates, the actuating segment 42 rotates about the driving shaft 43. As a result, a downstream end part of the actuating segment 42 swings in the ascent-descent direction (the up-down direction in the illustration).

When with the driving power of the driving source 71 the driving shaft 43 rotates counter-clockwise (the direction indicated by an arrow in the illustration), as it rotates the downstream end part of the actuating segment 42 ascends. Here, as mentioned above, the driving shaft 43 is disposed below the lift plate 40, and thus the actuating segment 42, which is fixed to the driving shaft 43, is located below the lift plate 40. Thus, as the downstream end part of the actuating segment 42 ascends, it makes contact with the bottom surface of the lift plate 40 and raises a downstream end part of the lift plate 40. In this way the lift mechanism 41 can raise and lower the downstream end part of the lift plate 40 with the swinging of the actuating segment 42 using the driving force of the driving source 71.

On the driving shaft 43, at a position different from the actuating segment 42 in the sheet width direction, a detection segment 44 is provided. The detection segment 44 is a small piece elongate in the sheet conveyance direction. In an upstream end part of the detection segment 44, a through hole 45 is formed, which penetrates the detection segment 44 in the sheet width direction. With the driving shaft 43 put through the through hole 45, the detection segment 44 is supported on the driving shaft 43 so as to be pivotable through a predetermined angle about the driving shaft 43. In a downstream end part of the detection segment 44, a light-shielding portion 46 in the form of a rectangular plate is formed.

As the actuating segment 42 pivots about the driving shaft 43 beyond the predetermined angle, following the pivoting of the actuating segment 42 the downstream end part of the detection segment 44 swings upward from a position parallel to the floor surface 38.

The detection segment 44 and the driving shaft 43 are coupled together via a link mechanism 47. The link mechanism 47 has an engagement projection (first engagement portion) 48, which projects from the driving shaft 43 in its radial direction, and an engagement hole (second engagement portion) 49, which is formed in the detection segment 44 and in which the engagement projection 48 is fitted. The engagement hole 49 is a hole in a shape depressed in the direction in which the engagement projection 48 projects. Of the inner circumferential surface of the engagement hole 49, a top part forms an engagement surface 50, which faces the outer circumferential surface of the engagement projection 48 in the circumferential direction of the driving shaft 43.

As shown in FIG. 2, in a state where the downstream end part of the actuating segment 42 is located at a comparatively low position and the lift plate 40 is lowered, that is, when the rotation angle of the driving shaft 43 is comparatively small, a gap 51 is left between the engagement projection 48 and the engagement surface 50. From this state, as the driving shaft 43 rotates counter-clockwise in the illustration, the engagement projection 48 too pivots about the driving shaft 43, and narrows the gap 51 between the outer circumferential surface of the driving shaft 43 and the engagement surface 50. From this state, as the driving shaft 43 further rotates, the engagement projection 48 and the engagement surface 50 make contact with each other. Then, as shown in FIG. 3, the rotation of the driving shaft 43 is transmitted via the engagement surface 50 to the detection segment 44, and the detection segment 44 pivots about the driving shaft 43. In this way the detection segment 44 pivots, with a time lag from the pivoting of the actuating segment 42, so as to follow the actuating segment 42.

Incidentally, when as the actuating segment 42 pivots counter-clockwise the lift plate 40 ascends from the lower limit position, the detection segment 44 couples with the actuating segment 42 at a coupling position and then as the actuating segment 42 pivots the detection segment 44 follows it while keeping a predetermined angle relative to it. On the other hand, when the lift plate 40 descends from a feeding position (the position where the top surface of insertion sheets P2 makes contact with the sheet feed roller 27), up to the coupling position the detection segment 44 pivots together with the actuating segment 42; as the lift plate 40 descends further until the detection segment 44 makes contact with the floor surface 38 and the rotation stops, then the actuating segment 42 alone pivots so that, at the lower limit position, the actuating segment 42 and the detection segment 44 lie substantially parallel to each other.

As shown in FIGS. 2 and 3, on the floor surface 38 of the sheet stack portion 16, adjacent to the detection segment 44 in the sheet conveyance direction, a remaining amount sensor 52 is provided. The remaining amount sensor 52 has a light-emitting portion 53 and a light-receiving portion (not illustrated) that face each other in the sheet width direction. The light-receiving portion of the remaining amount sensor 52 receives the light emitted from the light-emitting portion 53.

As shown in FIG. 2, when there is a gap 51 between the engagement projection 48 and the engagement surface 50, the light-shielding portion 46 of the detection segment 44 is located between the light-emitting portion 53 and the light-receiving portion of the remaining amount sensor 52. That is, when the rotation angle of the driving shaft 43 is comparatively small and the rotation of the driving shaft 43 is not transmitted to the detection segment 44, the light-shielding portion 46 of the detection segment 44 is at the same height as the light-emitting portion 53 of the remaining amount sensor 52. Thus the light emitted from the light-emitting portion 53 is intercepted by the light-shielding portion 46, and the light-receiving portion cannot receive the light emitted from the light-emitting portion 53.

From this state, when the driving shaft 43 rotates as described above until, as shown in FIG. 3, the light-shielding portion 46 ascends to a position higher than the light-emitting portion 53, the light-receiving portion receives the light emitted from the light-emitting portion 53. In this way, with the remaining amount sensor 52 sensing the detection segment 44 having ascended to a position higher than the light-emitting portion 53, it is possible to sense the ascent of the downstream end part of the actuating segment 42, that is, the lift plate 40 having ascended above a predetermined height. The sensing result of the remaining amount sensor 52 is transmitted to the controller 59.

As shown in FIGS. 2 and 3, the sheet feed unit 24 includes a device body 54, which is disposed over the lift plate 40; a sheet feed roller 27, which is provided in the device body 54; and a light-shielding segment 55, which protrudes from the device body 54 in the sheet width direction. The device body 54 is provided so as to be ascendable-descendable in the ascent-descent direction (the up-down direction in the illustration). The sheet feed roller 27 is adjacent to the upstream end opening 23 of the insertion conveyance passage 25 in the sheet conveyance direction.

At a position facing the device body 54 in the sheet conveyance direction, an ascent-descent sensor 56 is provided. The ascent-descent sensor 56 has a light-emitting portion 57 and a light-receiving portion (not illustrated) that face each other in the sheet width direction. The light-receiving portion receives the light emitted from the light-emitting portion 57. The ascent-descent sensor 56 can sense the insertion sheets P2 being in contact with the sheet feed roller 27 and thus the device body 54 being at a position higher than a predetermined height. The sensing result of the ascent-descent sensor 56 is transmitted to the controller 59 (see FIG. 4).

With the lift plate 40 lowered and thus with the sheet feed roller 27 out of contact with the top surface of the insertion sheets P2, the light-shielding segment 55 is located between the light-emitting portion 57 and the light-receiving portion of the ascent-descent sensor 56. Thus the light-shielding segment 55 intercepts the light emitted from the light-emitting portion 57 of the ascent-descent sensor 56. As the lift plate 40 ascends, the top surface of the insertion sheets P2 makes contact with the sheet feed roller 27 and then, as the lift plate 40 ascends further, the sheet feed roller 27 is pressed upward by the insertion sheets P2. Thus the device body 54 ascends, and the light-shielding segment 55 moves away from between the light-emitting portion 57 and the light-receiving portion of the ascent-descent sensor 56. Now the light-receiving portion receives the light emitted from the light-emitting portion 57.

As shown in FIGS. 2 and 3, with the lift plate 40 raised and thus with the top surface of the insertion sheets P2 in contact with the sheet feed roller 27, as the sheet feed roller 27 rotates in the sheet conveyance direction (counter-clockwise in the illustration), the insertion sheets P2 are fed toward the upstream end opening 23 of the relay conveyance passage 21. In this way the sheet feed roller 27 feeds one by one the insertion sheets P2 at the top surface of the plurality of insertion sheets P2 to the insertion conveyance passage 25.

From the state in FIG. 2, the insertion sheets P2 on the sheet stack portion 16 are fed one by one to the insertion conveyance passage 25. Meanwhile, as the remaining amount of insertion sheets P2 decreases, the position of the top surface of the insertion sheets P2 on the sheet stack portion 16 lowers. This weakens the force pressing the sheet feed roller 27, and the device body 54 descends. When the device body 54 descends until the light-shielding segment 55 comes back between the light-emitting portion 57 and the light-receiving portion of the ascent-descent sensor 56, the light emitted from the light-emitting portion 57 is intercepted by the light-shielding segment 55.

Here, the controller 59 is connected to the driving source 71, the remaining amount sensor 52, and the ascent-descent sensor 56. The controller 59 can control the diving of the driving source 71 based on the sensing result of the ascent-descent sensor 56 (see FIG. 4).

When the light-shielding segment 55 intercepts the light emitted from the light-emitting portion 57 of the ascent-descent sensor 56, the controller 59 operates the driving source 71 to raise the lift plate 40. Thus the top surface of the insertion sheets P2 ascends, with the result that the device body 54 ascends again and the light-shielding segment 55 too ascends. As shown in FIG. 3, when the light-shielding segment 55 ascends until it moves away from between the light-emitting portion 57 and the light-receiving portion of the ascent-descent sensor 56, the light-receiving portion of the ascent-descent sensor 56 receives the light emitted from the light-emitting portion 57. Then the controller 59 stops the ascent of the lift plate 40. The controller 59 raises and lowers the lift plate 40 by controlling the driving source 71.

As described above, the controller 59 raises the lift plate 40 until the top surface of the insertion sheets P2 makes contact with the sheet feed roller 27 and the ascent-descent sensor 56 senses the ascent of the light-shielding segment 55. As shown in FIG. 2, when the remaining amount of insertion sheets P2 is more than a predetermined amount, the lift plate 40 only ascends up to a position lower than the predetermined height. In this state, a small gap 51 is formed between the outer circumferential surface of the engagement projection 48 and the engagement surface 50, and the rotation of the driving shaft 43 is not transmitted to the detection segment 44. Thus the downstream end part (light-shielding portion 46) of the detection segment 44 is not raised and is located between the light-emitting portion 53 and the light-receiving portion of the remaining amount sensor 52. Thus the remaining amount sensor 52 senses the detection segment 44 not being raised.

From this state, as the sheet feed roller 27 rotates in the sheet conveyance direction and feeds the insertion sheets P2 one by one, as described above, the top surface of the insertion sheets P2 descends; in response, the controller 59 raises the lift plate 40. At this time the controller 59 controls the driving source 71 to rotate the driving shaft 43, and this narrows the gap 51 between the outer circumferential surface of the engagement projection 48 and the engagement surface 50. When the driving shaft 43 rotates further until the outer circumferential surface of the engagement projection 48 makes contact with the engagement surface 50 and the gap 51 disappears, the rotation of the driving shaft 43 is transmitted to the detection segment 44. From this state, as the driving shaft 43 further rotates, the detection segment 44 pivots gradually. As shown in FIG. 3, when the remaining amount of insertion sheets P2 becomes less than a predetermined amount, the light-shielding portion 46 of the detection segment 44 reaches a position higher than the light-emitting portion 53 of the remaining amount sensor 52, and the light-receiving portion of the remaining amount sensor 52 receives the light emitted from the light-emitting portion 53 (that is, the remaining amount sensor 52 senses the ascent of the downstream end part (light-shielding portion 46) of the detection segment 44.

In this way the remaining amount detecting portion 70 is configured to include the remaining amount sensor 52, the lift mechanism 41, the lift plate 40, the sheet feed unit 24, and the ascent-descent sensor 56 described above, and recognizes, based on the sensing result of the remaining amount sensor 52, the remaining amount on the sheet stack portion 16 being equal to or less than a predetermined amount.

Figure 4:
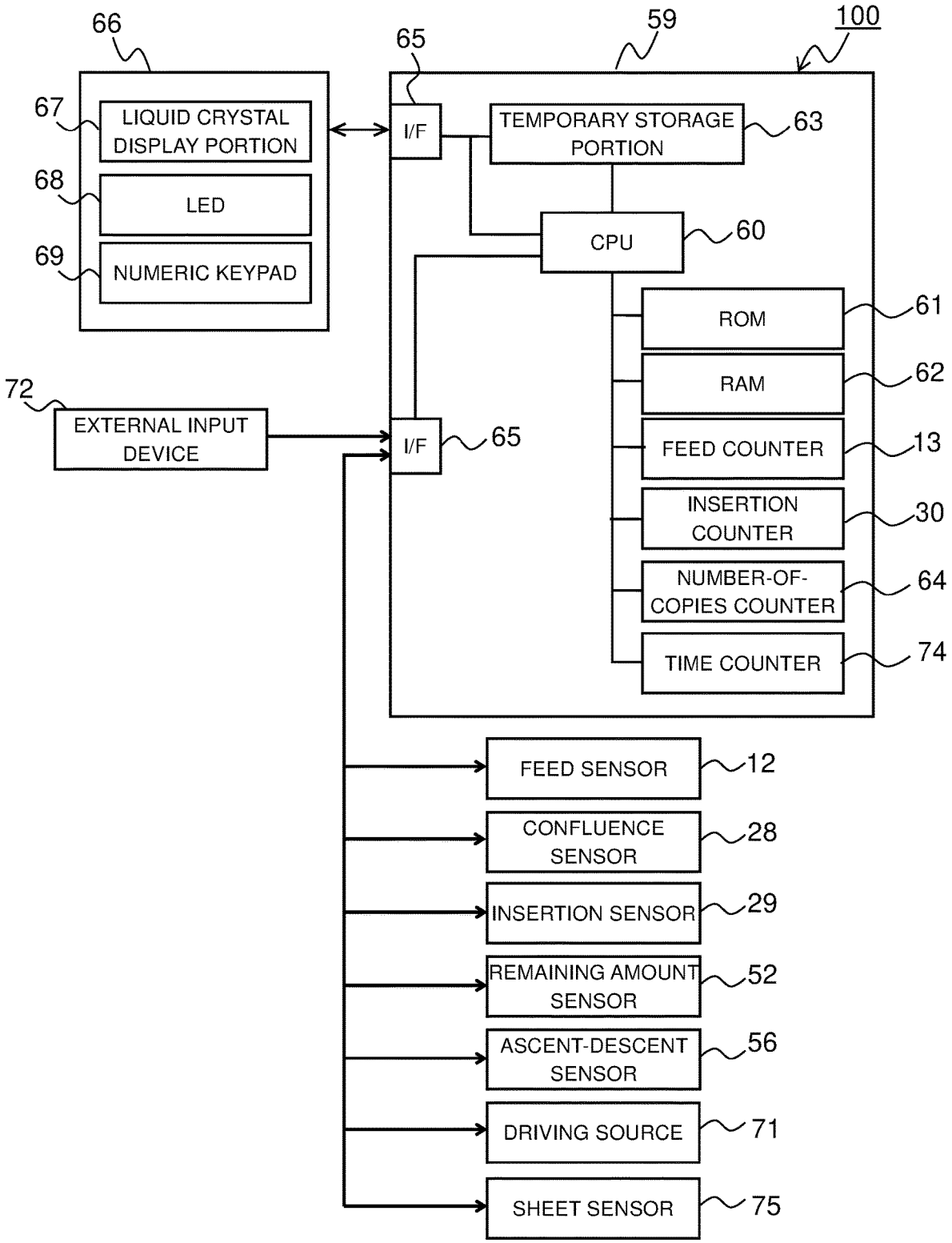
FIG. 4 is a block diagram showing control paths in the image forming system 100 according to the present disclosure.

FIG. 4 is a block diagram showing control paths in the image forming system according to the present disclosure. During the use of the image forming system, different parts of the apparatuses involved are controlled in various manners and thus the controller 59 actually has a complicate configuration. To avoid complication, the following description focuses on those parts of the controller 59 which are relevant in implementing the present disclosure.

The controller 59 at least includes a CPU (central processing unit) 60 as a central processor; a ROM (read-only memory) 61 (recording portion), which is a read-only storage; a RAM (random-access memory) 62, which is a readable, writable storage; a temporary storage portion 63, which temporarily stores image data and the like; a feed counter 13; an insertion counter 30, a number-of-copies counter 64, and an I/F (interface) 65. The controller 59 transmits and receives control signals via the I/F 65 among the image forming apparatus 1, the sheet feeding apparatus 2, and the sheet post-processing apparatus 3. While here the entire image forming system is controlled by the controller 59 in the image forming apparatus 1, a controller may be provided in the sheet post-processing apparatus 3 or in the sheet post-processing apparatus 3.

The ROM 61 stores programs and values necessary for the control of the system, that is, data and the like that are not changed. The RAM 62 stores data that is generated during the control of the system, and data and the like that are temporarily necessary for the control.

The ROM 61 also stores a value (hereinafter referred to as the "maximum passing number of sheets") that is set for each image formation mode to define the maximum number of recording sheets P1 that can be present between the first conveyance portion 5 and the confluence portion 19. The maximum passing number of sheets varies with the time required for image formation. The time required for image formation varies from one image formation mode to another, among monochrome printing, color printing, simplex printing, duplex printing, among different sheet sizes, etc. Accordingly the time that recording sheets P1 take to pass from the first conveyance portion 5 to confluence portion 19 varies likewise. An optimal maximum passing number of sheets can be set to suit the type of printing that a user intends to perform.

The feed counter 13 counts, based on the sensing result of the feed sensor 12, the number of recording sheets P1 fed from the first feed portion 4. The insertion counter 30 counts, based on the sensing result of the insertion sensor 29, the number of insertion sheets P2 fed from the sheet stack portion 16.

The number-of-copies counter 64 counts, based on the sensing result of the insertion sensor 29 and the count number in the insertion counter 30, the number of copies of bundles of sheets conveyed to the sheet post-processing apparatus 3. For example, in a case where a booklet containing one front cover and one back cover is produced, if when the count number in the insertion counter 30 is an odd number the insertion sensor 29 senses the feeding of an insertion sheet P2, the insertion sheet P2 so fed is recognized as an insertion sheet P2 to become the back cover of the booklet and is counted by the number-of-copies counter 64.

The feed counter 13, the insertion counter 30, and the number-of-copies counter 64 need not be provided separately; instead, for example, the RAM 62 can store the comparable counts.

The controller 59 also transmits control signals from the CPU 60 via the I/F 65 to different parts and devices within the system including the image forming apparatus 1, the sheet post-processing apparatus 3 and the sheet feeding apparatus 2. From those different parts and devices, signals indicating their status and input signals are transmitted via the I/F 65 to the CPU 60. The different parts and devices that the controller 59 controls includes, for example, the first conveyance portion 5 and the image recording portion 8 in the image forming apparatus 1, the second feed portion 80 in the sheet feeding apparatus 2, and the punch hole forming device 32, the end binding unit 33, and the stapler in the sheet post-processing apparatus 3 among others (see FIG. 1).

An operation portion 66 (input portion) includes a liquid crystal display portion 67 (indication portion), LEDs 68 for indicating various states, and a numeric keypad 69. By operating the operation portion 66, a user can make various settings on the image forming apparatus 1, the sheet post-processing apparatus 3, and the sheet feeding apparatus 2 to make them perform various functions such as image formation functions and post-processing functions. The liquid crystal display portion 67 indicates the status of the system, the progress of image formation, the number of copies printed, and the like and also, as a touch panel, allows various settings to be made for functions such as duplex printing and white-black reversal as well as magnification and density. The numeric keypad 69 is for setting the number of copies to be printed, for entering facsimile numbers of destinations when the image forming apparatus 1 has a facsimile function, etc.

The operation portion 66 further includes a Start button which the user operates to enter an instruction to start image formation, a Stop/Clear button which is operated to stop image formation, a Reset button which is used to recover the default settings for the various settings of the system, and the like.

A configuration is also conceivable in which an external input device 72 such as a personal computer or a tablet computer can be connected to the image forming system 100 so that instructions are entered via the external input device 72 to make various settings and perform various functions on the image forming apparatus 1, the sheet post-processing apparatus 3, and the sheet feeding apparatus 2.

Here, if the maximum passing number of sheets is less than the number of recording sheets P1 contained in one bundle of sheets (hereinafter this number will be referred to a the "planned output number of sheets"), no recording sheets P1 more than the planned output number of sheets are present between the sheet feed portion 6 and the confluence portion 19. Accordingly, when the remaining amount of the insertion sheets P2 run out and the feeding of new recording sheets P1 from the first feed portion 4 is stopped, even if several recording sheets P1 have already been fed, these sheets do not exceed in number the planned output number of sheets. These several recording sheets P1 already fed are, without being subjected to post-processing, discharged onto the subsidiary tray 35 of the sheet post-processing apparatus 3. Thus no booklet is produced without a front cover.

On the other hand, if the maximum passing number of sheets is more than the planned output number of sheets, even when the remaining amount of insertion sheets P2 run out and the feeding of new recording sheets P1 from the first feed portion 4 is stopped, at this point a number of recording sheets P1 exceeding the planned output number of sheets can be present between the sheet feed portion 6 and the confluence portion 19. Accordingly the planned output number of recording sheets P1 may be conveyed to the sheet post-processing apparatus 3, and thus a booklet without a front cover may be produced.

To avoid that, the controller 59 produces a booklet as usual when the maximum passing number of sheets is less than the planned output number of sheets as well as when the maximum passing number of sheets is more than the planned output number of sheets and in addition the remaining amount of insertion sheets P2 is more than a predetermined amount. If the maximum passing number of sheets is more than the planned output number of sheets and in addition the remaining amount of insertion sheets P2 is equal to or less than the predetermined amount, the controller 59 delays the feeding interval so that the number of recording sheets P1 present between the sheet feed portion 6 and the confluence portion 19 will not become more than the planned output number of sheets. In this way the image forming system 100 can prevent production of a booklet without a front cover and suppress a drop in productivity.

Such changing of the feeding interval for recording sheets P1 may be achieved by setting, only for the feeding of the next (i.e., first) recording sheet P1 after the feeding of an insertion sheet P2, a predetermined wait time such that this recording sheet P1 is fed with delayed timing (second timing) compared with the timing (first timing) for the feeding of other recording sheets P1, or by setting even wait times for the feeding of all recording sheets P1.

If recording sheets P1 are fed at varying intervals, the user may get the wrong idea that the image forming apparatus 1 is faulty. Setting even wait times for the feeding of all recording sheets P1 can prevent such misjudgment.

Figure 5:
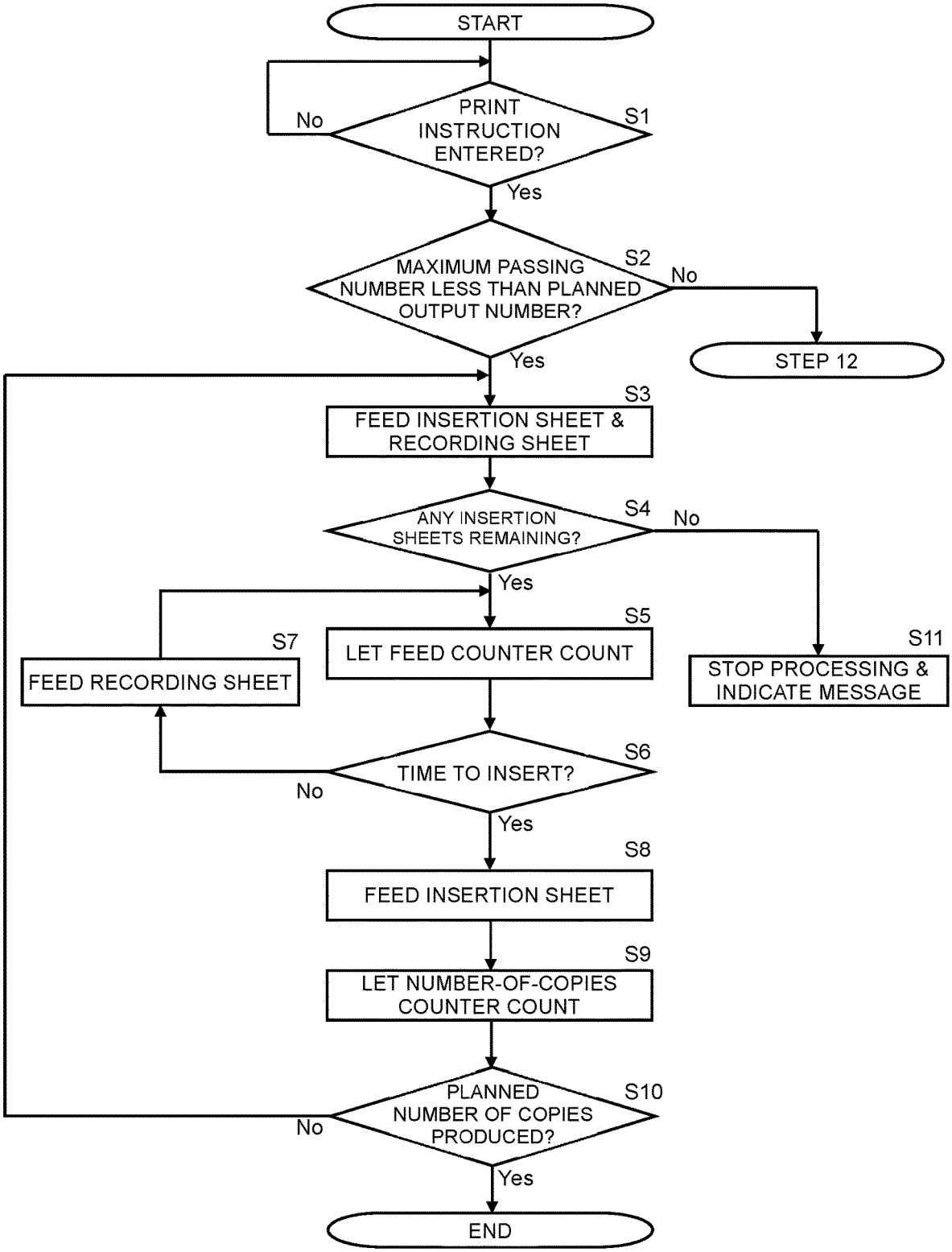
FIG. 5 is a flow chart showing one example of control for introduction of recording sheets P1 and insertion sheets P2.
Figure 6:
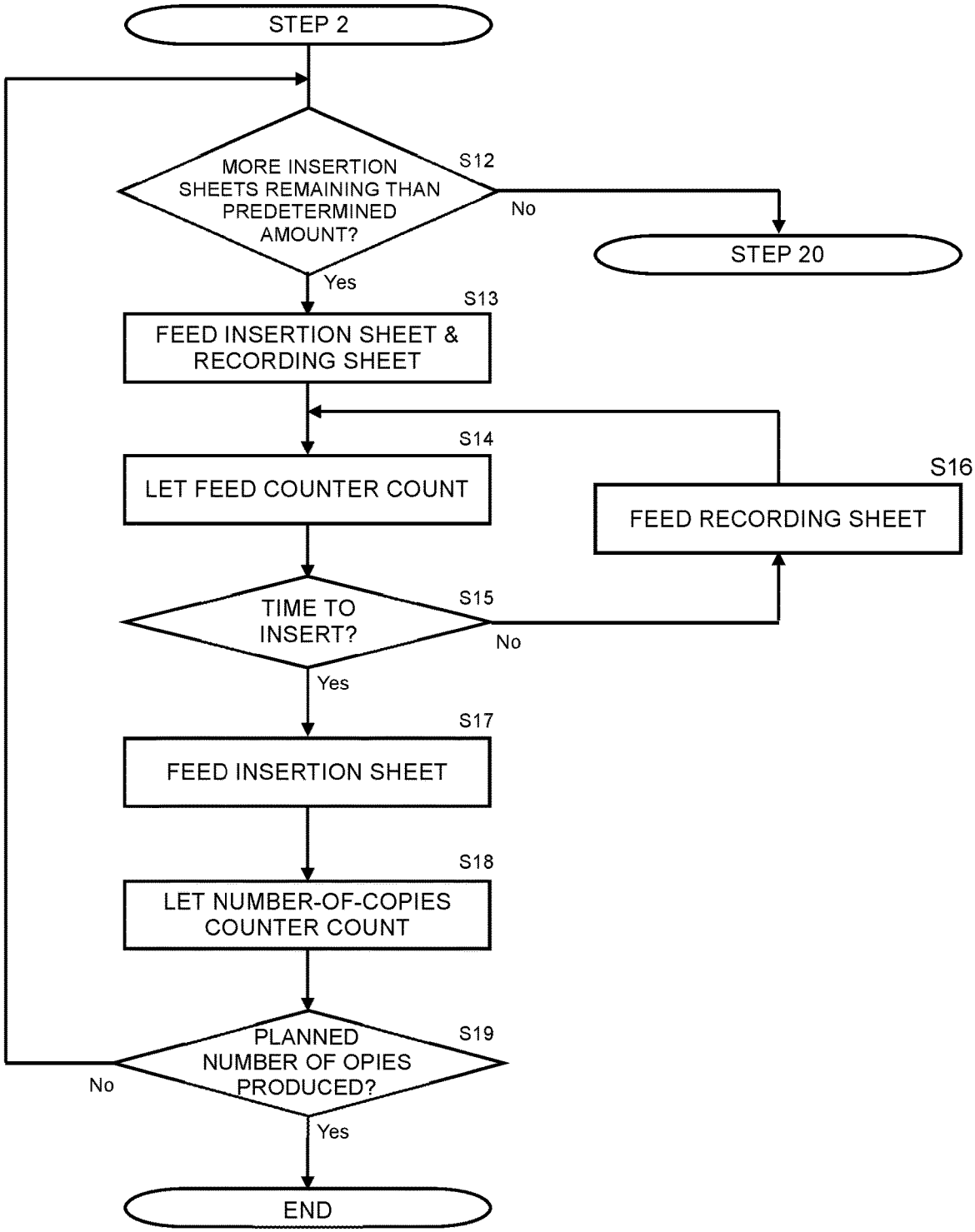
FIG. 6 is a flow chart showing one example of control for introduction of recording sheets P1 and insertion sheets P2.
Figure 7:
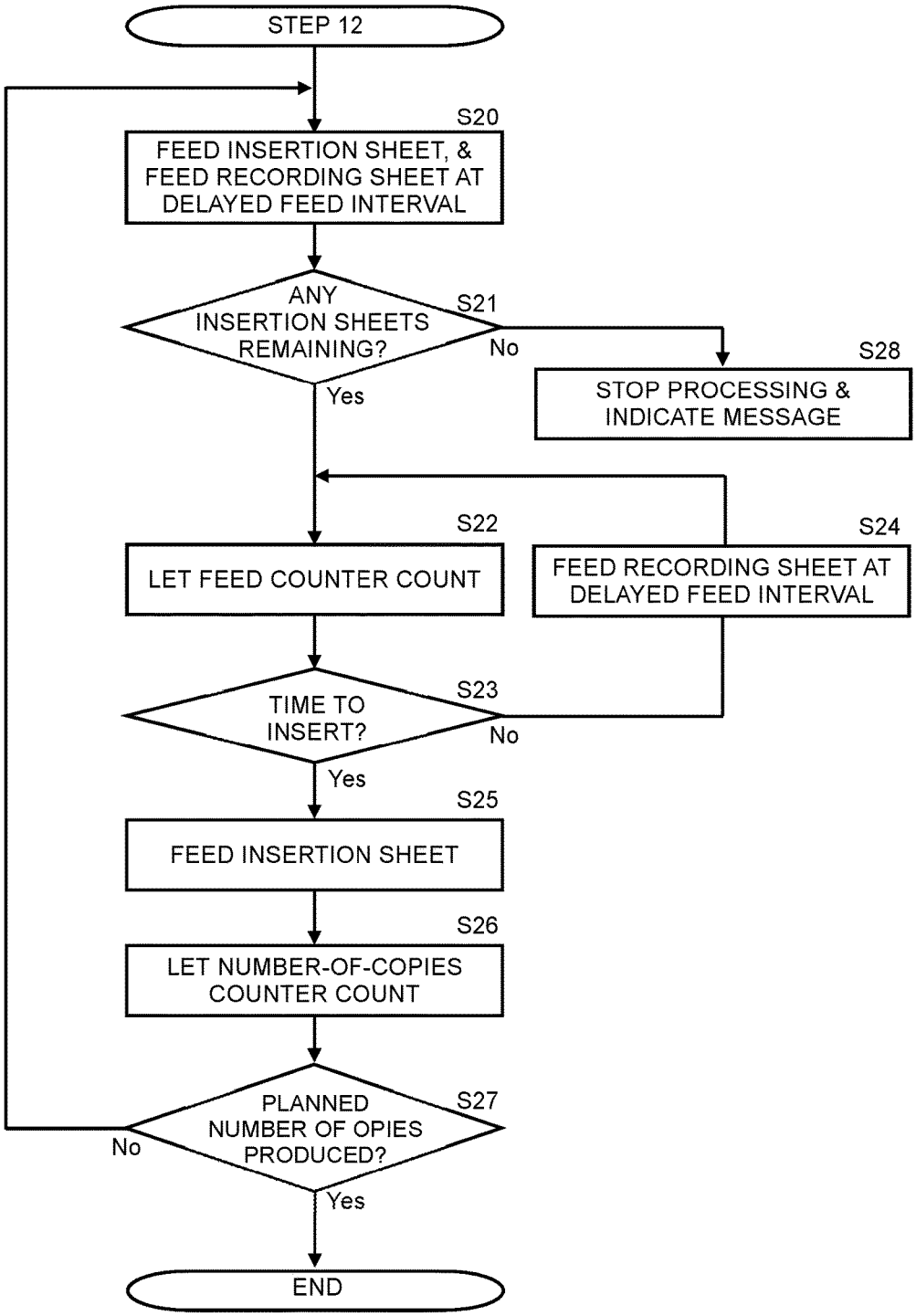
FIG. 7 is a flow chart showing one example of control for introduction of recording sheets P1 and insertion sheets P2.

Now the sheet conveyance control by the controller 59 will be described with reference to flow charts in FIGS. 5 to 7. FIGS. 5 to 7 are flow charts showing one example of the control for introduction of recording sheets P1 and insertion sheets P2.

As shown in FIG. 5, when a user enters a print instruction on the operation portion 66 (Step 1, "Yes"), based on the content of the print instruction, it is checked whether the maximum passing number of sheets is less than the planned output number of sheets (Step 2).

If in Step 2 it is judged that the maximum passing number of sheets is less than the planned output number of sheets (Step 2, "Yes"), a recording sheet P1 is fed from the first feed portion 4 and an insertion sheet P2 to become the front cover of a booklet is fed from the sheet stack portion 16 (Step 3). If in Step 2 it is judged that the maximum passing number of sheets is equal to or more than the planned output number of sheets (Step 2, "No"), a jump is made to Step 12 shown in FIG. 6.

When in Step 3 a recording sheet P1 and an insertion sheet P2 are fed, then based on the sensing result of the sheet sensor 75, it is checked whether or not there are any remaining amount of insertion sheets P2 on the sheet stack portion 16 (Step 4). If in Step 4 it is judged that there are any remaining amount of insertion sheets P2 on the sheet stack portion 16 (Step 4, "Yes"), then, based on the sensing result of the feed sensor 12, the feed counter 13 counts the number of recording sheets P1 fed (Step 5). If in Step 4 it is judged that there are no remaining amount of insertion sheets P2, the booklet production job is stopped, and an indication that there are no remaining amount of insertion sheets P2 is displayed on the liquid crystal display portion 67 (Step 11).

When in Step 5 the number of recording sheets P1 fed is counted, it is checked whether or not it is a time to insert an insertion sheet P2 to become the back cover of the booklet (Step 6). For example, in a case where, for the sake of discussion, a booklet containing three recording sheets is produced, at a time point that the count number in the feed counter 13 is 1 or 2. the number of recording sheets P1 fed has not yet reached the number of sheets (here, three) needed in one copy of the booklet, and thus it is not yet a time to insert an insertion sheet P2 (Step 6, "No"). In this case, an advance is made to Step 7, where a recording sheet P1 is fed, and Steps 5 to 7 are repeated until it is a time for insertion.

At the judgement in Step 6, when the count number in the feed counter 13 has reached the planned output number of sheets, that is, when it is a time to insert an insertion sheet P2 (Step 6, "Yes"), an insertion sheet P2 to become the back cover of the booklet is fed from the sheet stack portion 16 to the confluence portion 19 (Step 8). Subsequently, the feeding of this insertion sheet P2 to become the back cover is sensed by the insertion sensor 29, and the number-of-copies counter 64 counts it in the number of copies of bundles of sheets fed to the sheet post-processing apparatus 3.

Then it is checked whether or not a predetermined number of copies of bundles of sheets have been fed (Step 10). Here, for example, in a case where the image forming system 100 has been fed with a print instruction to produce five copies of the booklet, when the count number in the number-of-copies counter 64 is four or less, the number of bundles of sheets conveyed to the sheet post-processing apparatus 3 has not yet reached the planned produced number of copies (here, fived). Accordingly, a return is made to Step 3 so that Steps 3 to 10 described above are repeated until the count number in the number-of-copies counter 64 equals the planned produced number of copies.

If in Step 10 the count number in the insertion counter 30 is equal to the planned produced number of copies (Step 10, "Yes"), predetermined post-processing is performed on all the bundles of sheets conveyed to the sheet post-processing apparatus 3, and then the booklet production job is finished.

Incidentally, when in Step 3 a recording sheet P1 is fed, if within a predetermined time of the feeding the feed sensor 12 does not sense feeding of a recording sheet P1, it is judged that there are no remaining amount of recording sheets P1 in the first feed portion 4; thus the booklet production job is stopped, and an indication (omitted from illustration) that there are no remaining amount of recording sheets P1 is displayed on the liquid crystal display portion 67. The check of whether or not there are any remaining amount in the sheet feed cassette 4*a* may be achieved by separately providing a sensor for sensing whether or not there are any remaining amount on the sheet feed cassette 4*a* and judging based on the sensing result of the sensor.

Next, with reference to FIG. 6, a description will be given of the operation after in Step 3 the maximum passing number of sheets is judged to be equal to or more than the planned output number of sheets (Step 2, "No").

If in Step 2 it is judged that the maximum passing number of sheets is equal to or more than the planned output number of sheets (Step 2, "No"), subsequently it is checked whether or not the remaining amount of insertion sheets P2 on the sheet stack portion 16 is more than a predetermined amount (Step 12). If it is judged that the remaining amount of insertion sheets P2 on the sheet stack portion 16 is more than a predetermined amount (Step 12, "Yes"), a recording sheet P1 is fed from the first feed portion 4 and an insertion sheet P2 is fed from the sheet stack portion 16 (Step 13). If it is judged that the remaining amount of insertion sheets P2 is less than the predetermined amount (Step 12, "No"), a jump is made to Step 20 in FIG. 7.

When in Step 13 a recording sheet P1 and an insertion sheet P2 are fed, the feed counter 13 counts the number of recording sheets P1 fed (Step 14). Subsequently, it is checked whether or not it is a time to insert an insertion sheet P2 (Step 15). If it is not a time for insertion (Step 14, "No"), a recording sheet P1 is fed (Step 16), and Steps 14 to 16 are repeated until it is a time for insertion. If it is a time for insertion (Step 15, "Yes"), an advance is made to Step 17. Steps 17 and 18 are similar to Steps 8 and 9 described above, and therefore no overlapping description will be repeated.

In Step 19, it is checked whether or not a predetermined number of copies of bundles of sheets have been conveyed to the sheet post-processing apparatus 3. If the predetermined number of copies of bundles of sheets have been conveyed (Step 19, "Yes"), predetermined post-processing is performed on all the bundles of sheets conveyed to the sheet post-processing apparatus 3, and then the booklet production job is finished. If the predetermined number of copies of bundles of sheets have not been conveyed (Step 19, "No"), a return is made to Step 12.

Next, with reference to FIG. 7, a description will be given of the control after in Step 12 it is judged that the remaining amount of insertion sheets P2 is less than the predetermined amount (Step 12, "No").

If in Step 12 it is judged that the remaining amount of insertion sheets P2 on the sheet stack portion 16 is less than the predetermined amount, an insertion sheet P2 is fed from the sheet stack portion 16, and a recording sheet P1 is fed at a delayed feeding interval (Step 20). Subsequently, based on the sensing result of the sheet sensor 75, it is checked whether or not there remain any insertion sheets P2 on the sheet stack portion 16 (Step 21). If in Step 21 it is judged that there remain no insertion sheets P2 on the sheet stack portion 16 (Step 21, "No"), the booklet production job is stopped, and an indication that there are no remaining amount of insertion sheets P2 is displayed on the liquid crystal display portion 67 (Step 28).

If in Step 21 it is judged that there remains any insertion sheets P2 on the sheet stack portion 16 (Step 21, "Yes"), the feed counter 13 counts the number of recording sheets P1 fed (Step 22). Subsequently it is checked whether or not it is a time to insert an insertion sheet P2 (Step 23). Here, if it is not a time to insert an insertion sheet P2 (Step 23, "No"), a recording sheets P1 is fed from the first feed portion 4 at a delayed feeding interval (Step 24), and Steps 22 to 24 are repeated until it is a time for insertion.

The feeding interval for recording sheets P1 in Steps 20 and 24 is delayed such that the number of recording sheets P1 present between the confluence portion 19 and the first conveyance portion 5 during continuous printing is less than the number of recording sheets P1 contained in one bundle of sheets.

If in Step 23 it is judged that it is a time for insertion (Step 23, "Yes"), an insertion sheet P2 is fed (Step 25), and the number-of-copies counter 64 counts the bundle of sheets conveyed to the sheet post-processing apparatus 3 (Step 26).

When in Step 26 the number of copies of bundles of sheets is counted, subsequently it is checked whether or not the number of bundles of sheets conveyed to the sheet post-processing apparatus 3 has reached the planned produced number of copies of booklets (Step 27). Here, if the planned produced number of copies of booklets has been reached (Step 27, "Yes"), predetermined post-processing is performed on all the bundles of sheets conveyed to the sheet post-processing apparatus 3, and then the booklet production job is finished. If the planned produced number of copies has not been reached, a return is made to Step 20.

As described above, the controller 59 controls the feeding of recording sheets P1 such that no more than the planned output number of sheets are present between the sheet feed portion 6 and the confluence portion 19.

Here, generally, if an recording sheet is stopped at a position midway along a sheet conveyance passage in an image forming apparatus, the heat inside may burn the sheet, or may cause a deviation in the position in the sheet conveyance direction when operation is restarted, resulting in an image defect. To avoid that, when the remaining amount of insertion sheets runs out, any recording sheets present inside the image forming apparatus are not stopped inside the sheet conveyance passage but are conveyed on downstream. This may produce a booklet without a front cover. To solve this problem, in a known image forming system, to prevent production of a booklet without a front cover, when the remaining amount of insertion sheets becomes less than a predetermined amount, first an insertion sheet is fed and then the feeding of recording sheets is suspended until a sheet sensor senses a remaining amount of insertion sheets. As a result, as the remaining amount of insertion sheets becomes small, the feeding interval for recording sheets is inevitably delayed. This increases the time required to produce booklets, resulting in low productivity.

By contrast, in the image forming system 100 according to the embodiment, as described above, first it is checked whether or not the maximum passing number of sheets is less than the planned output number of sheets, and if so, even when the remaining amount of insertion sheets P2 becomes less than a predetermined amount, booklets are produced as usual (see FIG. 5). Moreover, as described above, even when the maximum passing number of sheets is equal to or more than the predetermined amount, so long as there are more than the predetermined amount of insertion sheets P2, there is no possibility of a booklet without a front cover being produced, and thus booklets are produced as usual. It is thus possible to suppress a drop in productivity.

In Steps 3 and 13, the feeding of an insertion sheet P2 to become a front cover and the feeding of a recording sheet P1 are performed in the same step. Here the insertion sheet P2 and the recording sheet P1 are fed with such timing that the insertion sheet P2 is introduced ahead of the recording sheet P1 into the sheet post-processing apparatus 3. So long as an insertion sheet P2 to become a front cover is introduced ahead of a recording sheet P1 into the sheet post-processing apparatus 3, the recording sheet P1 may be fed with the same timing as the insertion sheet P2, or the recording sheet P1 may be fed from the first feed portion 4 ahead of the insertion sheet P2 being fed from the sheet stack portion 16. In this way it is possible to feed the recording sheet P1 without waiting for the feeding of insertion sheet P2, and it is thus possible to produce booklets efficiently.

When the planned output number of sheets is less than the maximum passing number of sheets and in addition the remaining amount of insertion sheets P2 becomes less than a predetermined amount (Step 20), the subsequent feeding of recording sheets P1 is performed at a delayed feeding interval (Steps 20 and 24). In this way it is possible to prevent, when the remaining amount of insertion sheets P2 runs out, to prevent more than the planned output number of recording sheets P1 from being present between the confluence portion 19 and the first conveyance portion 5, and it is thus possible to prevent production of a booklet without a front cover.

As described above, the image forming system 100 according to the embodiment prevents production of a booklet without a front cover, and suppress a drop in productivity.

The embodiment described above is in no way meant to limit the scope of the present disclosure, which can thus be implemented with many modifications made without departure from the spirit of the present disclosure.

For example, while in the embodiment described above the maximum passing number of sheets is stored beforehand in the ROM 61, instead the maximum passing number of sheets may be calculated every time a booklet production job is performed. In that case, a time counter 74 (time counting portion) can be provided within the controller 59, and in the ROM 61 are recorded the conveyance speed for recording sheets P1 in each image formation mode and the feeding interval (time) for recording sheets P1 for each image formation mode (see FIG. 4).

When a user enters a print instruction, a recording sheet P1 is fed. When its feeding is sensed by the feed sensor 12, the time counter 74 mentioned above starts to count time. When the recording sheet P1 reaches the confluence portion 19 and the confluence sensor 28 senses the recording sheet P1, the time counter 74 stops counting time. Based on the counted time as well as the conveyance speed and the feeding interval selected based on the content of the print instruction from the user, the maximum passing number of sheets is calculated. The calculated maximum passing number of sheets is stored in the temporary storage portion 63 or the RAM 62.

Depending on the implementation of the sheet feeding apparatus 2 connected to the image forming apparatus 1 on its downstream side, the distance from the first feed portion 4 to the confluence portion 19 varies, and the maximum passing number of sheets too varies. Moreover, depending on the image formation mode, the time required for image formation varies, and the maximum passing number of sheets too varies. By employing the configuration described above, it is possible to perform the control described above (Step 2 in FIG. 5) based on an accurate maximum passing number of sheets even when the sheet feeding apparatus 2 is replaced with another or when the image formation mode is changed. It is thus possible to more effectively suppress a drop in productivity and prevent production of a booklet without a front cover.

The maximum passing number of sheets can be calculated only in the first booklet production job after the sheet feeding apparatus 2 is replaced with another or the image formation mode is changed, and the calculated value can be stored in the RAM 62. Unless the sheet feeding apparatus 2 is replaced with another or the image formation mode is changed, the calculated value stored in the RAM 62 can be used in the next or any later booklet production job. In that case, the maximum passing number of sheets stored in the RAM 62 may be updated every time the sheet feeding apparatus 2 is replaced or the image formation mode is changed.

When the remaining amount of insertion sheets P2 on the sheet stack portion 16 becomes less than the predetermined amount, it is possible to perform the control described above (Step 20 through Step 28) and also display on the liquid crystal display portion 67 a message indicating the low remaining amount. This permits the user to recognize the low remaining amount of insertion sheets P2 at such an early stage that the user can add insertion sheets P2 before the remaining amount of insertion sheets P2 runs out and the booklet production job is stopped. It is thus possible to suppress a drop in productivity. The low remaining amount can be indicated, instead of by displaying a message on the liquid crystal display portion 67, by delivering a voice message from a loudspeaker, by lighting a warning lamp, by sounding a buzzer, or otherwise.

The present disclosure finds applications in image forming systems comprising a combination of a sheet feeding unit for inserting cover sheets, slip sheets, or the like among sheets having images formed by an image forming apparatus and a sheet post-processing unit for performing post-processing such as binding. In such applications the present disclosure helps prevent production of a booklet without a front cover while suppressing an increase in production costs, an increase in equipment size, and a drop in productivity.

What is claimed is:

1. An image forming system, comprising:

an image forming apparatus including:

a sheet storage portion that stores recording sheets;

a first feed portion that feeds one by one the recording sheets from the sheet storage portion downstream in a sheet feeding direction; and an image forming portion that forms images on the recording sheets fed by the first feed portion;

a first conveyance path that conveys the recording sheets fed from the first feed portion to a discharge port;

a sheet feeding unit including:

a sheet stacking portion on which insertion sheets are stacked;

a second feed portion that feeds one by one the insertion sheets stacked on the sheet stacking portion; and a relay conveyance portion that receives the recording sheets fed by the first feed portion and the insertion sheets fed by the second feed portion to convey them downstream in the sheet conveyance direction, the sheet feeding unit being coupled to the image forming apparatus on a downstream side thereof;

a sheet post-processing unit coupled to the sheet feeding unit on a downstream side thereof, the sheet post-processing unit forming a bundle of sheets containing the insertion sheets and the recording sheets and performing predetermined post-processing on the bundle of sheets;

a controller that controls the image forming apparatus, the sheet feeding unit, and the sheet post-processing unit, wherein the sheet feeding unit includes a remaining amount detecting portion that detects a remaining amount of the insertion sheets on the sheet stacking portion, the relay conveyance portion includes a merge portion at which an insertion conveyance path for conveying the insertion sheets merges with a relay conveyance path for conveying the recording sheets, and when, during continuous printing, an existing number of the recording sheets present in a conveyance path including the first conveyance path and the relay conveyance path is more than a constituting number of the recording sheets contained in the bundle of sheets and the remaining amount of the insertion sheets detected by the remaining amount detecting portion is equal to or less than a predetermined amount level, the controller controls feeding of the recording sheets from the first feed portion such that the existing number of the recording sheets in the conveyance path is less than the constituting number of the recording sheets.

2. The image forming system according to claim 1, further comprising a counting device that counts the existing number of the recording sheets in the conveyance path, wherein when the remaining amount of the insertion sheets is equal to or less than the predetermined amount level and the existing number of the recording sheets counted by the counting device is more than the constituting number of the recording sheets, the controller controls the feeding of the recording sheets from the first feed portion such that the existing number of the recording sheets is less than the constituting number of the recording sheets.

3. The image forming system according to claim 2, further comprising a recording portion that records the existing number of the recording sheets counted by the counting device, wherein when the constituting number of the recording sheets is less than the existing number of the recording sheets recorded in the recording portion, the controller controls the feeding of the recording sheets from the first feed portion such that, when the remaining amount of the insertion sheets is equal to or less than the predetermined amount level, the existing number of the recording sheets is less than the constituting number of the recording sheets.

4. The image forming system according to claim 1, wherein during continuous printing, the controller feeds the recording sheets with first timing using the first feed portion and, when the remaining amount of the insertion sheets is equal to or less than the predetermined amount level, the controller controls the first feed portion such that, of a plurality of the recording sheets contained in one bundle of sheets, only a first recording sheet is fed with second timing longer than the first timing.

5. The image forming system according to claim 1, wherein when the remaining amount of the insertion sheets is equal to or less than the predetermined amount level, the controller controls the first feed portion such that a plurality of the recording sheets contained in one bundle of sheets are fed from the sheet stacking portion at delayed equal intervals.

6. The image forming system according to claim 1, further comprising an input portion that accepts input of the remaining amount level of the insertion sheets.

7. The image forming system according to claim 1, further comprising an indication portion, wherein when the remaining amount of the insertion sheets is equal to or less than the predetermined remaining amount level, the controller causes the notification portion, to notify the remaining amount of the insertion sheets is at a low level.

* * * * *